United States Patent [19]

Tamaki et al.

[11] Patent Number: 4,494,613

[45] Date of Patent: Jan. 22, 1985

[54] METHOD AND APPARATUS FOR DRIVING HOLLOW PILES INTO THE GROUND

[75] Inventors: Hiroaki Tamaki, Hiratsuka; Joji Nakamura, Kamakura, both of Japan

[73] Assignee: Kabushiki Kaisha Komatsu Seisakusho, Tokyo, Japan

[21] Appl. No.: 357,270

[22] Filed: Mar. 11, 1982

[51] Int. Cl.[3] ..... E02D 7/26

[52] U.S. Cl. ..... 173/74; 173/78; 173/105; 175/69; 175/394; 175/415; 175/417

[58] Field of Search ..... 173/1, 104, 105, 145, 173/74, 77, 78; 175/415, 417, 422, 394, 69

[56] References Cited

U.S. PATENT DOCUMENTS

| | | | |
|---|---|---|---|
| 1,290,340 | 1/1919 | Pippin | 175/393 |
| 1,659,327 | 2/1928 | Montgomery | 175/393 |
| 2,085,941 | 7/1937 | Arnold | 175/393 |
| 2,352,412 | 6/1944 | Sandstone | 175/323 |
| 2,745,650 | 5/1956 | Smith | 175/285 |
| 3,043,383 | 7/1962 | Newbold | 175/394 |
| 3,077,235 | 2/1963 | Govin | 175/285 |
| 3,130,798 | 4/1964 | Schramm | 175/69 |
| 3,391,544 | 7/1968 | Dalzko | 175/323 |
| 3,887,017 | 6/1975 | Frederick | 173/22 |
| 4,193,462 | 3/1980 | Blaschke | 175/394 |
| 4,286,935 | 7/1981 | Okuno | 83/53 |
| 4,319,784 | 3/1982 | Claringbull | 175/69 |

FOREIGN PATENT DOCUMENTS 947072 3/1972 Japan .

*Primary Examiner*—James M. Meister
*Assistant Examiner*—John L. Knoble
*Attorney, Agent, or Firm*—Armstrong, Nikaido, Marmelstein & Kubovcik

[57] ABSTRACT

A method and apparatus for driving a hollow pile into the ground. By using a hollow rod having a short auger fixedly secured to a leading end portion thereof, excavated earth and sand are lifted to and around the upper portion of the auger where compressed air is spouted from nozzle orifices formed in the hollow rod thereby lifting the excavated earth and sand through the hollow pile and consequently discharging the same from the hollow pile. As earth and sand are discharged from the hollow pile, the pile is sunk or driven into the ground.

9 Claims, 24 Drawing Figures

28
5
5'
4
29
16
$15_1$
18
20
13
$15_2$
17
19
21
21
22
23
31
34
33
24
25
30
27
32
26
$15_3$
1
2
2
6
3
7
61
50
40
55
52
51
47
48
49
53
44
45
46
54
41
42
43

METHOD AND APPARATUS FOR DRIVING HOLLOW PILES INTO THE GROUND

BACKGROUND OF THE INVENTION

This invention relates to a method and apparatus for driving a pile into the ground.

There have hitherto been known a first method of driving a pile into the earth or ground by striking it by means of a hammer and a second method of driving a hollow pile by eliminating the soil therein by excavation by using an auger etc.

The first pile driving method is advantageous in that its work execution cost is low, but is disadvantageous in that it will accompany increased vibration and high level noise caused thereby.

Whilst, the second pile driving method is advantageous in that the vibration and noise created during the execution thereof can be reduced, but is disadvantageous in that the rate of execution of work becomes low thereby increasing the work execution cost.

Stating in more detail, the second pile driving method comprises placing an auger inside a hollow pile and rotating the auger so as to excavate the earth in the leading end of the pile and remove the excavated earth therefrom thereby enabling the pile to be driven successively into the earth. Therefore, it is required to remove and lift the excavated soil from the lower part of the hollow pile to the upper part thereof by means of an auger having a length approximately equal to the pile to be driven. Accordingly, the longer the pile to be driven in the earth, the longer the auger to be used and the distance along which the excavated earth and sand are carried, and larger the auger torque.

As a result, the auger cannot be rotated at high speed and so the excavated earth and sand removing speed will become low and consequently the pile driving speed will become low thereby increasing the work execution cost.

In order to increase the rate of removal of excavated earth and sand, the speed of rotation of the auger has to be increased. In such a case, however, provision of a high horse power electric motor is required and the torque created thereby will increase and therefore there is a risk that a body to support the motor may upset.

SUMMARY OF THE INVENTION

It is therefore an object of the present invention to provide a method of driving a hollow pile into the ground which can overcome the above noted problems of the prior art.

Another object of the present invention is to provide a method of driving a hollow pile into the ground wherein excavated earth and sand can be quickly discharged from the hollow pile leading to a quick driving of the pile into the ground.

A further object of the present invention is to provide an economical method of driving a hollow pile into the ground.

A still further object of the present invention is to provide an apparatus for driving a hollow pile into the ground which is used in the method of the present invention.

In accordance with an aspect of the present invention, there is provided a method driving a hollow pile into the ground, comprising the steps of: (a) inserting a hollow rod into the hollow pile, said hollow rod having a short auger fixedly secured to a leading and portion thereof and a cutter mounted to the leading end thereof; (b) excavating the ground by the cutter and lifting excavated sand and earth to and around the upper portion of the short auger by rotating the same; and (c) spouting highly pressurized air from a nozzle provided at a leading end portion of the hollow rod thereby lifting the excavated earth and sand to and beyond the upper end of the hollow pile and discharging the same from above the hollow pile while continuously excavating the ground by the cutter thereby driving the hollow pile deep into the ground.

In accordance with another aspect of the present invention, there is provided an apparatus for driving a hollow pile into the ground, comprising: a crane vehicle having a support member pivotally mounted thereto; a mounting member mounted for up and down movement relative to the support member, said mounting member having detachably mounted thereto a hollow pile to be driven into the ground; a drive mechanism mounted to said crane vehicle for up and down movement relative to the support member, said drive mechanism having a hollow drive shaft and means for rotating the drive shaft; a cylindrical member having a discharge opening mounted on said mounting member; a hollow rod detachably connected to said hollow drive shaft and driven thereby; a cutter mounted to the leading end of said hollow rod; a short auger fixedly secured to a leading end portion of said hollow rod; a first nozzle orifice formed in said hollow rod at a portion immediately above said short auger; a source of compressed air; and first conduit means for connecting said source of compressed air to the inside of said hollow drive shaft thereby spouting compressed air from said nozzle orifice.

The above and other objects, features and advantages of the present invention will be readily apparent from the following description taken in conjunction with the accompanying drawings.

DESCRIPTION OF THE PREFERRED EMBODIMENTS

The present invention will now be described in detail below by way of example only with reference to the accompanying drawings.

Figure 1:
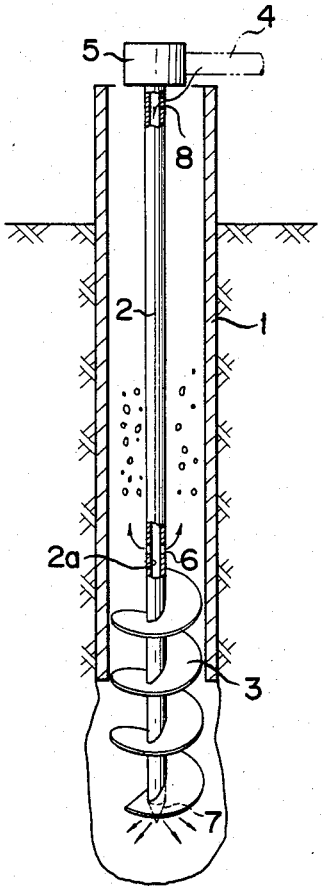
FIG. 1 is a schematic elevational view partly in cross-section explanatory of the pile driving principle of the present invention.

FIG. 1 is a schematic explanatory view of an apparatus for carrying out a pile driving method according to the present invention. Placed inside a hollow pile 1 such as hollow concrete pipe or steel pipe or the like is a hollow shaft or rod 2 having an auger 3 formed as an integral part thereof at its leading end. The other end of the hollow shaft 2 is connected through a transmission 5' with a motor 5 mounted on a body such as crane vehicle 4. The hollow shaft 2 has a first nozzle orifice 6 formed therein so as to communicate with the hollow inside 2*a* of the shaft 2 at a position slightly upper than the auger 3 and a second nozzle orifice 7 formed so as to communicate with the hollow inside 2*a* at the leading end thereof below the auger 3. The arrangement is made such that pressurized fluid such as compressed air or compressed air mixed with viscous fluid and water etc. is supplied through an inlet 8 into the hollow inside 2*a* of the shaft 2.

One embodiment of the pile driving method according to the present invention will now be described below with reference to FIG. 2A to 2G.

Figure 2A:
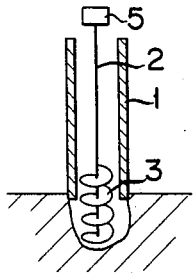
FIGS. 2A to 2G show schematically how a series of hollow piles can be driven into the ground according to the present invention.

(1) After inserting a hollow shaft 2 provided with an auger 3 into a hollow pile 1, the pile is set on the earth surface and the shaft 2 is allowed to rotate by means of a motor 5 so that the earth and sand may be drawn by the auger 3 into the inside of the pile 1 at a position upper than the auger (Refer to FIG. 2A).

Figure 2B:
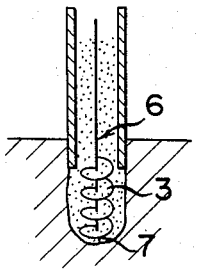
Figure 2C:
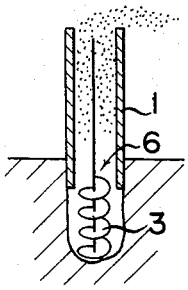

(2) The drawn in earth and sand will be carried upwards along the inside of the pile 1 and discharged therefrom by the action of the compressed air spouting from the first nozzle 6 and the second nozzle 7 (Refer to FIGS. 2B and 2C).

Figure 2D:
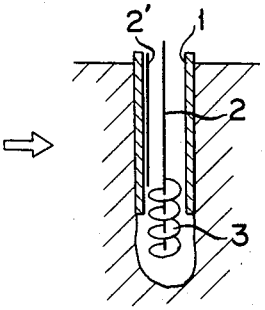

(3) Upon the completion of driving of the pile 1, another hollow shaft 2' is inserted in the pile 1 (Refer to FIG. 2D).

Figure 2E:
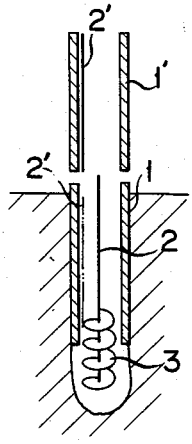

(4) Another pile 1' is suspended and held above the driven pile 1 and the another hollow shaft 2' is pulled up to the inside of the pile 1' (Refer to FIG. 2E).

Figure 2F:
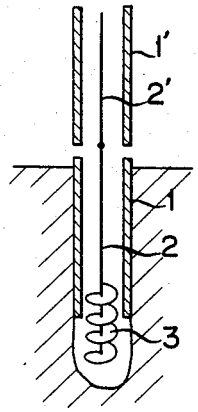

(5) Then, the lower end of the another hollow shaft 2' is connected with the upper end of the hollow shaft 2 provided with the auger 3 (Refer to FIG. 2F).

Figure 2G:
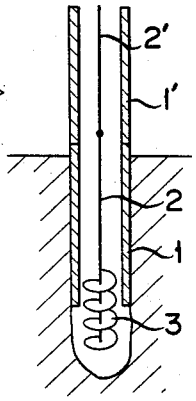

(6) The another pile 1' is connected with the driven pile 1 (Refer to FIG. 2G).

(7) The another pile 1' is connected with the motor 5.

(8) The operations described in the items (2) and (3) are repeated.

By carrying out the above-mentioned steps, the pile 1 may be driven successively into the earth.

As mentioned above, because the excavated earth and sand may be conveyed upwards along the whole distance inside the pile 1 not only by means of the auger 3 but also by the action of the compressed air, the earth and sand discharge speed can be increased and the pile driving speed or the work execution speed can be increased thereby enabling the work execution cost to be reduced remarkably, and also even if the number of revolution of the auger 3 is increased, the turning torque can be kept low and irrespective of the high speed rotation of the auger there is no need of increasing the capacity of the motor 5 and there is no fear of upsetting of the body 4.

Further, if and when a viscous fluid is mixed into the compressed air, even gravels or pebbles can be readily removed at a high speed using a part thereof as soil plug.

Figure 3A:
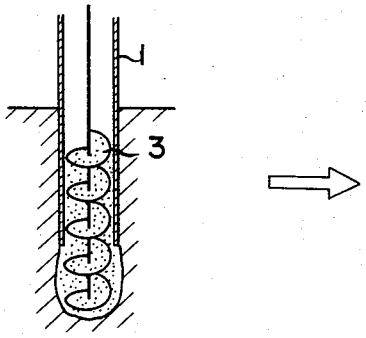
FIGS. 3A to 3D show schematically but in different way from FIGS. 2A to 2G how excavated earth and sand are discharged from the hollow pile.
Figure 3B:
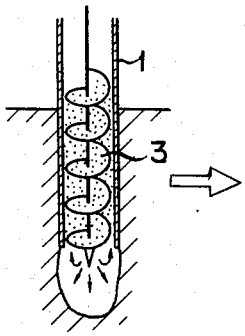
Figure 3C:
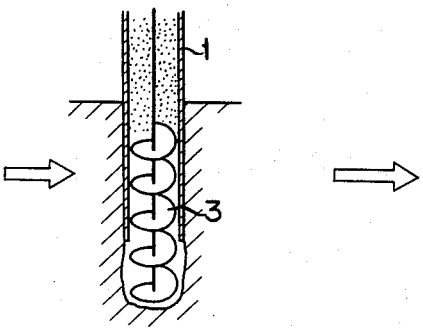
Figure 3D:
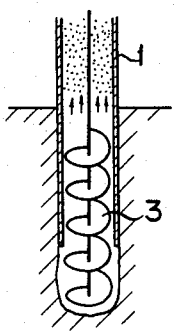

Further, as an alternative method for removing the excavated earth and sand, as shown in FIGS. 3A to 3D, after the auger 3 has been pulled up, it may be rotated forwardly and moved downwards while compressed air is being spouted through the second nozzle orifice 7 at the leading end of the hollow shaft so that the excavated earth and sand may be moved upwardly above the auger (FIG. 3C), and then the earth and sand remaining inside the pile 1 may be removed upwardly under pressure by allowing compressed air to spout through the first and second nozzle orifices 6 and 7 (FIG. 3D).

Although in the above-mentioned embodiment the first nozzle orifice 6 and the second nozzle orifice 7 are provided, it is only necessary to provide either one of them.

In the next place, one embodiment of an apparatus for carrying out the pile driving method according to the present invention will be described with reference to FIGS. 4 to 8.

Figure 4:
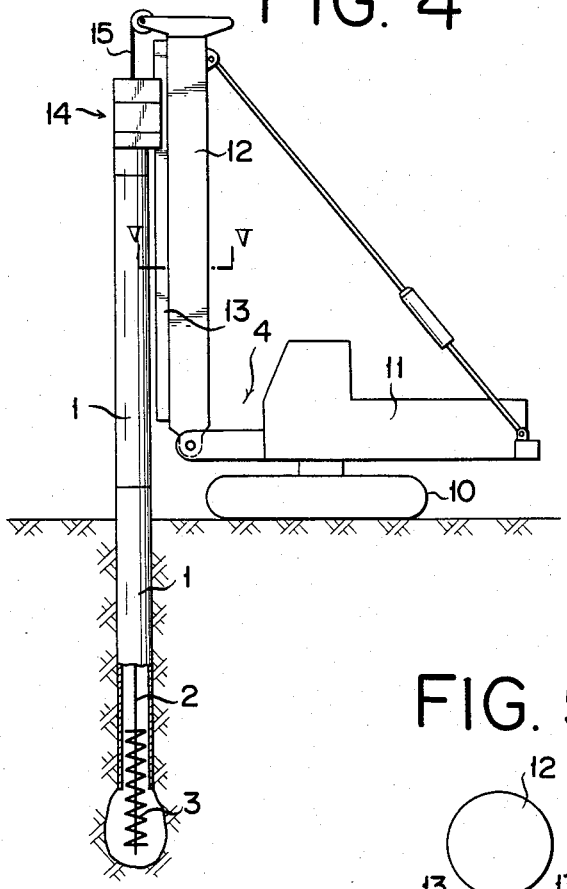
FIG. 4 is a schematic side elevational view partly in cross-section of a pile driving apparatus mounted on a crane vehicle according to the present invention.
Figure 5:
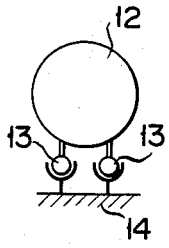
FIG. 5 is a cross-sectional view taken along the line V—V of FIG. 4.

FIG. 4 is an overall side elevational view of a pile driving arrangement comprising a crane vehicle 4 which is comprised of an undercarriage 10 and a revolving upper body 11. Attached to the revolving upper body 11 is a leader 12. The leader 12 has a guide 13 on which a pile driving unit 14 is mounted so as to slide freely vertically therealong. The pile driving unit 14 may be moved up and down by means of a wire 15 wound round a winch not shown.

Figure 6:
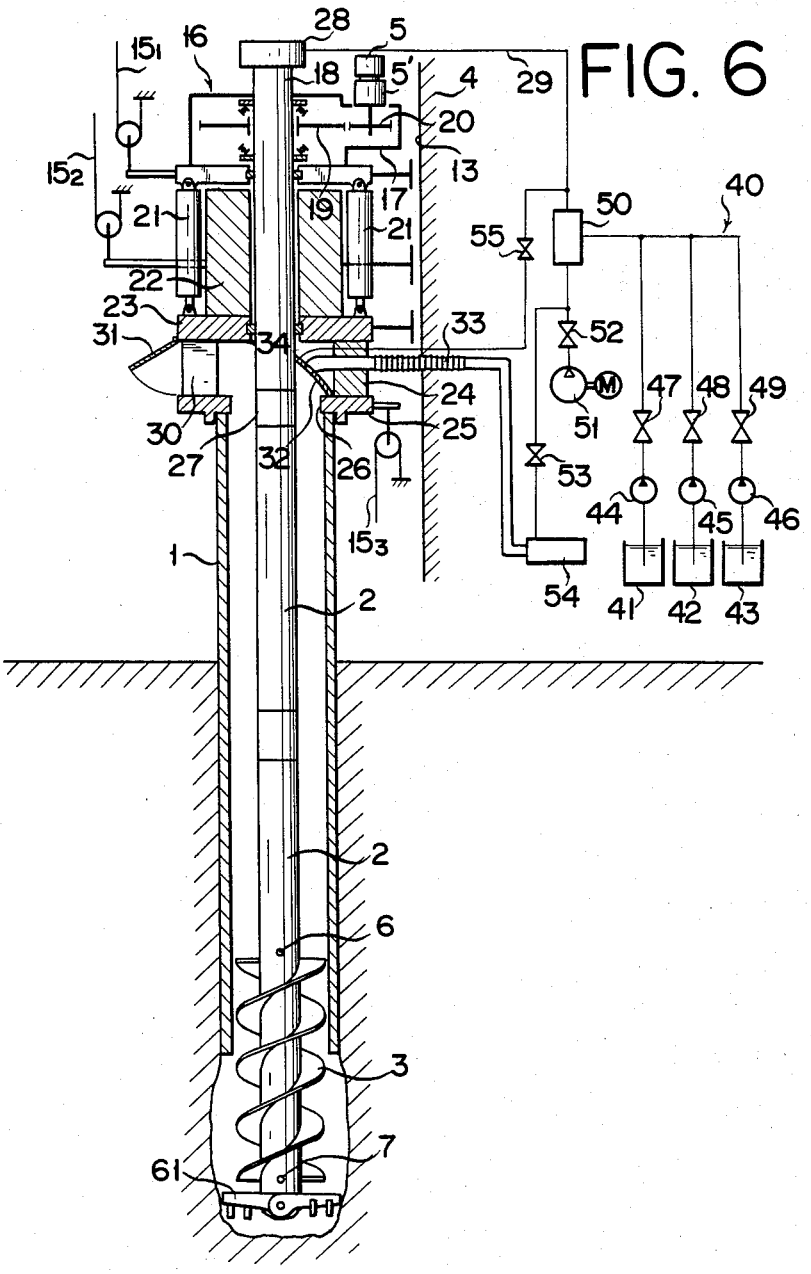
FIG. 6 is a total construction view partly in cross-section of a pile driving apparatus according to the present invention.

The pile driving apparatus is constructed as shown in FIG. 6.

Stating in detail, a gear case 17 for a driving unit 16 is vertically slidably mounted on and along the guide 13. A hollow drive shaft 18 extends through the gear case 17 and is provided with a gear 19 which engages with a gear 20. The gear 20 is in turn connected with a motor 5 installed in the gear case 17 through the transmission 5'.

In the gear case 17, there is suspended a base plate 23 provided with a weight 22 through cylinders 21. The base plate 23 is vertically slidably fitted to the guide 13. A cap 25 is mounted to the lower part of the base plate 23 through an annular member 24. The lower part of the drive shaft 18 passes through a hole 26 of the cap 25 and is connected through a coupling 27 with a hollow shaft 2 suspending therefrom. The upper end of the drive shaft 18 is connected through a swivel joint 28 with a first hose 29.

The aforementioned annular member 24 is formed with an earth and sand discharge port 30 adapted to be opened and shut by means of a cover 31. The annular member 24 has a cover 32 fitted inside which is adapted to connect the hole 26 to the earth and sand discharge port 30. The cover 32 has a hole 34 formed therein and which is connected with a second hose 33.

A pile 1 is detachably mounted onto the cap 25.

The gear case 17, the weight 22 and the cap 25 may be moved vertically by wires or cables $15_1$, $15_2$ and $15_3$, respectively.

Reference numeral 40 denotes a pressurized fluid supply means which comprises a first tank 41 filled with water, a second tank 42 filled with a viscous fluid and a third tank 43 filled with cement milk. The fluids contained in the tanks 41, 42 and 43 are fed by means of first, second and third pumps 44, 45 and 46 through first, second and third valves 47, 48 and 49 into a mixer 50 into which the compressed air from a pneumatic pump 51 is supplied through a fourth valve 52 and is fed into the aforementioned first hose 29.

The compressed air from the pneumatic pump 51 is also supplied through a fifth valve 53 into a plug forming material supply unit 54 so that the plug forming material may be supplied into the second hose 33.

Figure 7:
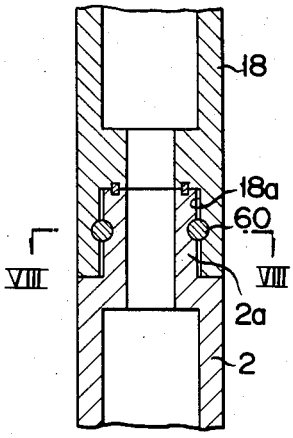
FIG. 7 is a cross-sectional view of a coupling section between a hollow rod and a hollow drive shaft.
Figure 8:
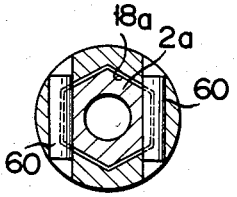
FIG. 8 is a cross-sectional view taken along line VIII—VIII of FIG. 7.

The above-mentioned coupling 27 comprises, as shown in FIGS. 7 and 8, a small diameter portion 2*a* formed in the upper part of the hollow shaft 2, a recess 18*a* which is formed in the lower part of the drive shaft 18 and in which the small diameter portion 2*a* is fitted and pins 60 adapted to be inserted in the fitting portions thereof. The hollow shaft 2 and the drive shaft 18 may be readily connected and disconnected by inserting and removing the pins 60.

Whilst, mounted on the lowermost leading end of the hollow shaft 2 is an expandable cutter 61 which assumes a retracted condition as shown by imaginary dash line when it is being inserted in the pile 1 but assumes an outwardly expanded condition by the resistance of the earth to be excavated when excavation of soil is made.

The operation of the pile driving apparatus will now be described below.

By driving the motor 5, the drive shaft 18 is rotated thereby rotating the hollow shaft 2 and the auger 3 fitted thereto.

The weight of the weight 22 is exerted through the base plate 23, the annular member 24 and the cap 25 onto the pile 1 per se thereby to give the pile 1 a thrusting force. If the thrusting force is insufficient, it can be increased by pushing the cap 25 down by means of a cable $15_3$. At that time, the cylinders 21 are extended. Further, by moving the weight 22 up and down by means of the cable $15_2$ so as to strike it against the base plate 23, an impact force can be exerted on the pile 1.

The cap 25 supports the upper end of the pile 1 and serves to set the center position of the hollow shaft 2 to be driven.

Further, the extension and contraction of the cylinders 21 permits the length of attachment between the drive unit 16 and the cap 25 to be varied as desired so that the relative positions of the connecting members can be controlled.

Still further, the compressed air discharged by the pneumatic pump 51 will flow through the fourth valve 52, the mixer 50, the first hose 29 and the swivel joint 28 into the inside of the hollow drive shaft 18 and will be spouted through the first and second nozzle orifices 6 and 7 or either one of them.

Further, by selectively opening and closing the first, second and third valves 47, 48 and 49, any of water, viscous fluid and cement milk can be supplied into the mixer 50 and mixed with the compressed air. Therefore, various proportions of the mixed fluid may be spouted through both the first and second nozzle orifices 6 and 7 or either one of them, and also water, viscous fluid and cement milk etc. may be spouted independently.

Moreover, by opening a sixth valve 55, the compressed air may be supplied under pressure into the earth discharge port 30 so that the earth and sand deposited on the earth discharge port 30 may be cleaned and removed.

Further, since a plug forming material can be supplied by the plug forming material supply unit 54, in case the excavated earth and sand are gravels through which the compressed air can blow readily, a plug forming material i.e. viscous fluid and cement milk etc. may be supplied from above on the gravels thereby forming a plug thereof and facilitating their removal.

Figure 10:
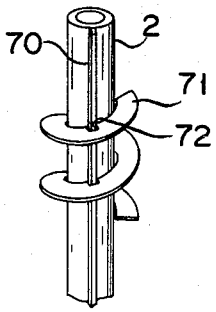
FIG. 10 is a fragmentary perspective view of a hollow rod having a free auger mounted thereon through a rib.
Figure 11:
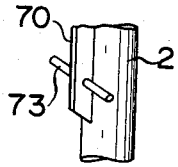
FIG. 11 is a fragmentary perspective view of a hollow rod showing a section in which a stopper is mounted to a rib.
Figure 9:
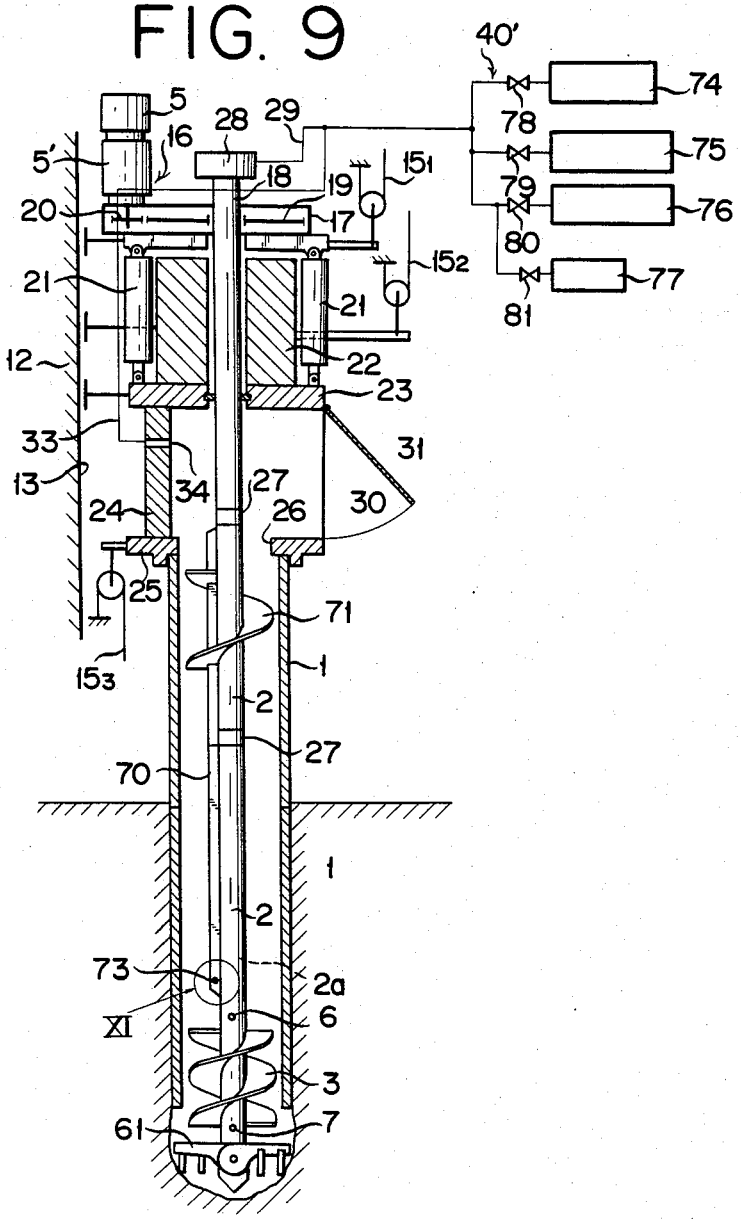
FIG. 9 is similar to FIG. 6 but showing another embodiment of the present invention.

Referring to FIG. 9, there is shown another embodiment of the present invention. In this embodiment, the hollow shaft 2 has a rib 70 fixedly secured to one side thereof, the rib 70 having a free auger 71 attached thereto. Stating in more detail, as shown in FIG. 10, the free auger 71 has a notch 72 formed therein in which the rib 70 is fitted. The free auger 71 is arranged so that it can be rotated together with the hollow shaft 2 by means of the notch 72 and the rib, but it can be moved vertically along the rib 70. Further, the lower end of the rib 70 extends to a position slightly above the auger 3 and the first nozzle orifices 6, and as shown in FIG. 11, a stopper 73 is provided to prevent the free auger 71 from dropping further.

Reference numeral 40' denotes a pressurized fluid supply means which comprises a cement milk supply unit 74, a first compressor 75, a second compressor 76 and a water supply unit 77 which are connected through first, second, third and fourth valves 78, 79, 80 and 81, respectively, with first and second hoses 29 and 33. The other configuration of this embodiment is same as that of the aforementioned embodiment. In this embodiment, in case of excavating the ground consisting mainly of clays, the rib 70 fitted to the hollow shaft 2 serves to break down the earth and sand deposited on the inner surface of the pile 1 thereby preventing occurrence of blockage of the pile. Consequently, it becomes possible to move the earth and sand inside the pile 1 smoothly so that they can be discharged outside the pile at a very high speed.

Further, the rib 70 may be provided on one side of the hollow shaft 2 as shown, but ribs 70 may be provided on both sides thereof.

Figure 12A:
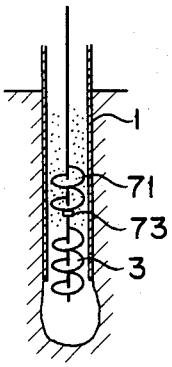
FIGS. 12A to 12D show schematically how excavated earth and sand are discharged from the hollow pile when the pile driving apparatus shown in FIG. 9 is employed.
Figure 12B:
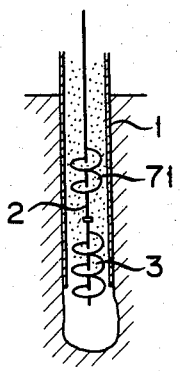
Figure 12C:
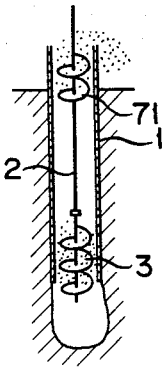
Figure 12D:
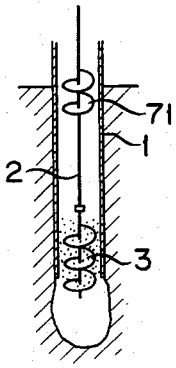

Next, referring to FIGS. 12A to 12D the action or function of the free auger in the second embodiment will be explained below. The free auger 71 is attached to the hollow shaft 2 through the rib 70. The earth and sand excavated by the action of the cutter 61 will be carried upwards by means of the auger 3 and will form a loose lump around it. The free auger 71 will drop on the earth and sand lumped around the auger 3 and rotate together with the hollow shaft 2 and move down through them until it strikes against the stopper 73 (FIG. 12A).

As a result, both the free auger 71 and the earth and sand sent to the free auger 71 will cause blockage of the pile 1 thereby forming an earth and sand plug. By allowing compressed air to spout through the nozzle orifices 6 and 7 continuously or intermittently, the pressure in the region between the free auger 71 and the auger 3 will increase and push upwards the free auger 71 together with the plug-like earth and sand (Refer to FIG. 12B). When the free auger 71 has been pushed up within the annular member 25, the earth and sand will be discharged from the soil discharge port 30. At that time, since the compressed air may spout through the hole 34, the excavated earth and sand can be readily discharged (Refer to FIG. 12C).

When the excavated earth and sand are discharged, the pressure in the area between the free auger 71 and the auger 3 will be reduced and consequently the free auger 71 will descend until it strikes against the stopper as mentioned above (Refer to FIG. 12D).

By repeating the aforementioned operations, the earth and sand excavated by the cutter 61 may be discharged efficiently outside the pile to be driven into the earth by the action of both the spouting of compressed air and the free auger 71.

Further, in the arrangement of the second embodiment, the amount of the compressed air supplied into the hollow shaft 2 can be increased or decreased by opening and shutting off the second and third valves 79 and 80 of the pressurized fluid supply means 40'. Therefore, the amount of the compressed air to be supplied into the pile can be adjusted depending on the nature or property of the earth and sand to be excavated, and also it can be increased or decreased intermittently by opening and closing the third valve 80 intermittently thereby enabling an impact force to be given to the pile being driven.

It is to be understood that the foregoing description is merely illustrative of preferred embodiments of the present invention, and that the scope of the invention is not to be limited thereto, but is to be determined by the scope of the appended claims.

What is claimed is:

1. An apparatus for driving a hollow pile into the ground, comprising:

a crane vehicle having a support member pivotally mounted thereto;

a mounting member mounted for up and down movement relative to the support member, said mounting member having detachably mounted thereto a hollow pile to be driven into the ground;

a drive mechanism mounted to said crane vehicle for up and down movement relative to the support member, said drive mechanism having a hollow drive shaft and means for rotating the drive shaft;

a cylindrical member having a discharge opening mounted on said mounting member;

a cover mounted in said cylindrical member adapted for discharging earth and sand in a plug state;

a hollow rod detachably connected to said hollow drive shaft and driven thereby;

a cutter mounted to the leading end of said hollow rod;

a short auger fixedly secured to a leading end portion of said hollow rod;

a first nozzle orifice formed in said hollow rod at a portion immediately above said short auger;

a second nozzle orifice formed in said hollow rod at a portion between said cutter and said short auger;

a source of compressed air;

a source of liquid;

means connected to said source of compressed air and liquid for mixing the compressed air with the liquid; and first conduit means for connecting said mixing means to the inside of said hollow drive shaft.

2. An apparatus as recited in claim 1 further comprising a weight mounted on said cylindrical member, said weight being movable vertically relative to said cylindrical member thereby imparting shock loads thereto.

3. An apparatus as recited in claim 1 further comprising second conduit means for introducing compressed air from said source of compressed air into said cylindrical member so as to help discharge earth and sand from said discharge opening.

4. An apparatus as recited in claim 1 wherein said cutter is pivotally mounted to said hollow rod in such a way that diameter of said cutter becomes minimum when no cutting load is imposed thereon but the same becomes maximum when full cutting load is imposed thereon.

5. An apparatus as recited in claim 1 further comprising a further source of liquid and third conduit means for introducing the liquid in said further source of liquid into said hollow drive shaft.

6. An apparatus for driving a hollow pile into the ground, comprising:

a crane vehicle having a support member pivotally mounted thereto;

a mounting member mounted for up and down movement relative to the support member, said mounting member having detachably mounted thereto a hollow pile to be driven into the ground;

a drive mechanism mounted to said crane vehicle for up and down movement relative to the support member, said drive mechanism having a hollow drive shaft and means for rotating the drive shaft;

a cylindrical member having a discharge opening mounted on said mounting member;

a hollow rod detachably connected to said hollow drive shaft and driven thereby;

a cutter mounted to the leading end of said hollow rod;

a short auger fixedly secured to a leading end portion of said hollow rod;

an elongated rib fixedly secured to an outer surface of said hollow rod in a longitudinal direction for scraping off earth and sand adhered to the interior wall of said hollow pile;

a first nozzle orifice formed in said hollow rod at a portion immediately above said short auger;

a second nozzle orifice formed in said hollow rod at a portion between said cutter and said short auger;

a source of compressed air;

a source of liquid;

means connected to said sources of compressed air and liquid for mixing the compressed air with the liquid; and first conduit means for connecting said mixing means to the inside of said hollow drive shaft.

7. An apparatus as recited in claim 6 further comprising an auxiliary auger mounted to said hollow rod through said elongated rib in such a way that said auxiliary auger is rotated with said hollow rod but is free to move in a longitudinal direction.

8. An apparatus as recited in claim 7 wherein said cutter is pivotally mounted to said hollow rod in such a way that diameter of said cutter becomes minimum when no cutting load is imposed thereon but the same becomes maximum when full cutting load is imposed thereon.

9. An apparatus as recited in claim 7 further comprising a further source of liquid and third conduit means for introducing the liquid in said further source of liquid into said hollow drive shaft.

* * * * *